US007356294B2

(12) United States Patent
Ishida et al.

(10) Patent No.: US 7,356,294 B2
(45) Date of Patent: Apr. 8, 2008

(54) DEVELOPING ROLL

(75) Inventors: Masanori Ishida, Komaki (JP); Kazushi Yamaguchi, Inuyama (JP); Koji Yamaguchi, Mizunami (JP); Yasuyuki Hayasaki, Komaki (JP)

(73) Assignee: Tokai Rubber Industries, Ltd., Komaki-Shi (JP)

( * ) Notice: Subject to any disclaimer, the term of this patent is extended or adjusted under 35 U.S.C. 154(b) by 140 days.

(21) Appl. No.: 11/313,687

(22) Filed: Dec. 22, 2005

(65) Prior Publication Data

US 2006/0147229 A1 Jul. 6, 2006

(30) Foreign Application Priority Data

Dec. 24, 2004 (JP) ..... 2004-374473
Mar. 29, 2005 (JP) ..... 2005-095790
Nov. 8, 2005 (JP) ..... 2005-323829

(51) Int. Cl.
*G03G 15/08* (2006.01)

(52) U.S. Cl. ..... 399/286

(58) Field of Classification Search ..... 399/265, 399/276, 279, 286; 492/28, 30
See application file for complete search history.

(56) References Cited

U.S. PATENT DOCUMENTS 4,258,115 A * 3/1981 Magome et al. ..... 399/279 X
4,836,136 A * 6/1989 Natsuhara ..... 399/276
4,960,050 A * 10/1990 Hatch ..... 492/30 X
5,794,109 A * 8/1998 Ota et al. ..... 399/286

FOREIGN PATENT DOCUMENTS

JP 8-328374 12/1996
JP 10-239985 9/1998

* cited by examiner

*Primary Examiner*—Sandra L. Brase
(74) *Attorney, Agent, or Firm*—Westerman, Hattori, Daniels & Adrian, LLP.

(57) ABSTRACT

A developing roll which may reduce stress imparted on toner and have uniform transportability of toner. The developing roll comprises a shaft, an elastic layer provided on an outer peripheral surface of the shaft, and a cylindrical outermost layer provided directly or indirectly via a layer on an outer peripheral surface of the elastic layer, wherein an outer peripheral surface of the outermost layer is formed into a rough surface by distribution of multiple dimples in such a manner that open ends thereof do not overlap one another on the surface and a portion other than the dimples on the rough surface forms a remaining portion of a cylindrical shape.

11 Claims, 3 Drawing Sheets

DEVELOPING ROLL

BACKGROUND OF THE INVENTION

1. Field of the Invention

The present invention relates to a developing roll for use in an electrophotographic apparatus such as a copying machine or a printer.

2. Description of the Art

In recent years, the melting point of toner for use in an electrophotographic apparatus such as a copying machine or a printer is lowered for fixing the toner instantly in response to demand for speed-up of copying or printing. Further, toner particles are made smaller in response to demand for high image quality in copying or printing, and also the toner has high electrostatic charge in response to the demand for prolonging life of copied or printed images. Since such toner-tends to have low resistance to stress, a soft developing roll has been recently popularly used for reducing stress imparted on toner.

Such a developing roll generally comprises a shaft, an elastic layer made of rubber or the like formed on an outer peripheral surface of the shaft and a coat layer (outermost layer) formed on an outer peripheral surface of the elastic layer (for example, see Japanese Unexamined Patent Publication No. 10-239985). In such a soft developing roll, the coat layer is provided with a function to form a uniform toner layer, as well as functions to be electrostatically charged and thus transfer the toner in cooperation with other material (s) for forming such a coat layer.

Among such functions, the function for transferring the toner is generally given by roughening the surface of the coat layer formed on an outer peripheral surface of the developing roll. There are various methods for roughening the surface. For example, there is the prevalent method that hard particles (sandy particles) such as urethane resin are dispersed in the coat layer of the developing roll so as to roughen the surface of the coat layer.

However, when the hard particles are dispersed in the coat layer, the surface hardness is increased due to the hard particles, which imparts stress on the toner. For this reason, the toner is easy to be deteriorated. If toner has less resistance to stress, the toner is easier to be deteriorated.

Further, the rough surface formed by such dispersion of the hard particles is usually composed of a combination of convex portions where hard particles exist and concave portions where hard particles do not exist. For this reason, if the mixing amount, density of dispersion and the like of the hard particles are not correctly controlled, the heights of the convex portions and the depths of the concave portions vary, so that variation of the surface roughness on the coat layer varies widely. Further, since the surface roughness changes with time due to cohesion of the hard particles, it is difficult to maintain a uniform surface roughness for a long time. Therefore, the developing roll in which the surface is roughened by the hard particles tends to have a non-uniform transportability of the toner and may affect image quality.

In view of the foregoing, it is an object of the present invention to provide a developing roll which may reduce stress imparted on the toner and have uniform transportability of the toner.

SUMMARY OF THE INVENTION

According to a first aspect of the present invention to achieve the aforesaid objects, there is provided a developing roll comprising a shaft, an elastic layer provided on an outer peripheral surface of the shaft, and a cylindrical outermost layer provided directly or indirectly via a layer on an outer peripheral surface of the elastic layer, wherein an outer peripheral surface of the outermost layer is formed into a rough surface by distribution of multiple dimples in such a manner that open ends thereof do not overlap one another on the surface.

According to a second aspect of the present invention to achieve the aforesaid objects, there is provided a developing roll comprising a shaft and a cylindrical elastic layer provided on an outer peripheral surface of the shaft, or comprising a shaft, an elastic layer provided on an outer peripheral surface of the shaft and a cylindrical outermost layer provided directly or indirectly via a layer on an outer peripheral surface of the elastic layer, wherein each outer peripheral surface of the elastic layer is formed into a rough surface by distribution of multiple dimples in such a manner that open ends thereof do not overlap one another on the surface.

According to the developing roll of the present invention, an outer peripheral surface of the developing roll is formed into a rough surface by distributing multiple dimples on an outer peripheral surface of an elastic layer or an outermost layer, each having a cylindrical shape, without using hard particles for forming such a rough surface. For this reason, a surface hardness can be maintained low and thus stress imparted on toner can be reduced. Further, since the surface roughness does not suffer from cohesion of the hard particles and thus does not change with time, the surface roughness can be constantly maintained for a long time. For forming the above-mentioned dimples, since distribution density, sizes and the like of the dimples can be relatively easily controlled, a surface roughness on an outer peripheral surface of the developing roll can be relatively easily controlled. Further, variation in the surface roughness can be relatively easily lessened and thus transportability of toner can be uniformed. Still further, since the rough surface is formed such that open ends of the dimples do not overlap one another, a portion other than the dimples on the rough surface forms a remaining portion of a cylindrical shape. When the developing roll of the present invention contacts a layer-forming blade, a photoreceptor drum or the like with pressure, such pressure contact is conducted by a portion other than the dimples (remaining portion of a cylindrical shape). For this reason, such pressure contact becomes so-called surface contact conducted axially from one end to the other end of the developing roll, variation in contact pressure can be lessened. (On the other hand, in the rough surface formed by dispersion of hard particles, the heights of peaks of multiple convex portions vary and such peaks contact the photoreceptor drum or the like in terms of points.) As a result, according to the developing roll of the present invention, high image quality, free from uneven concentration, streaks, distortion and the like, can be obtained.

According to the developing roll of the present invention, an outer peripheral surface of the developing roll is formed into a rough surface by distributing multiple dimples on an outer peripheral surface of an elastic layer or an outermost layer, each having a cylindrical shape, without using hard particles for forming such a rough surface. For this reason, stress imparted on toner can be reduced. Further, since the surface roughness does not suffer from cohesion of the hard particles and the like, variation in the surface roughness can be lessened and thus transportability of toner can be uniformed. Still further, since the rough surface is formed such that open ends of the dimples do not overlap one another, a portion other than the dimples on the rough surface forms a remaining portion of a cylindrical shape. Therefore, the developing roll of the present invention can contact a layer-forming blade, a photoreceptor drum or the like approximately uniformly with pressure in terms of so-called surface contact, and thus high quality images can be obtained.

When a reflection layer for reflecting a laser is formed between the elastic layer and the outermost layer, concave portions can be formed only on a layer (such as an outermost layer) outer than the reflection layer by laser etching.

Especially, when each dimple has an open end diameter of 20 to 200 μm and a depth of 1.5 to 20 μm, surface roughness can be formed in such a manner that the resultant developing roll has suitable toner transportability and thus occurrence of fog phenomenon (i.e., toner is scattered in a non-image portion on a sheet of paper) can be prevented.

Further, when the dimples are regularly aligned circumferentially and axially, surface roughness of the developing roll can be further uniformed and thus toner transportability can be further uniformed.

Further, when each row of dimples extended from one end to the other end is inclined against a central axis of the developing roll, the each row of dimples contacts an object material such as a photoreceptor drum gradually from one end to the other end in a row consecutively as the developing roll rotates, and thus even fewer image defects such as uneven concentration or streaks may be caused.

DESCRIPTION OF THE PREFERRED EMBODIMENTS

The present invention will hereinafter be described in detail by way of an embodiment thereof. However, the present invention is not limited thereto.

Figure 1:
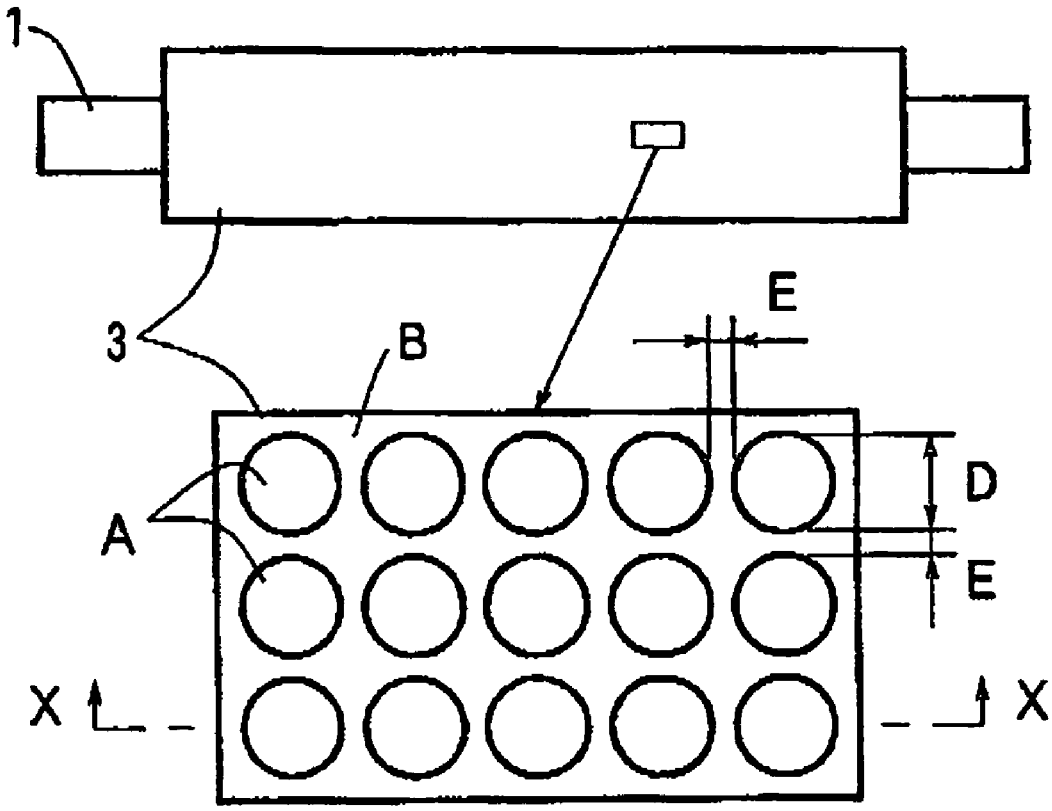
FIG. 1(*a*) is a front view illustrating one embodiment of a developing roll according to the present invention and a partly enlarged view illustrating a surface thereof, and FIG. 1(*b*) is a sectional view in an X-X line of FIG. 1(*a*)
Figure 1:
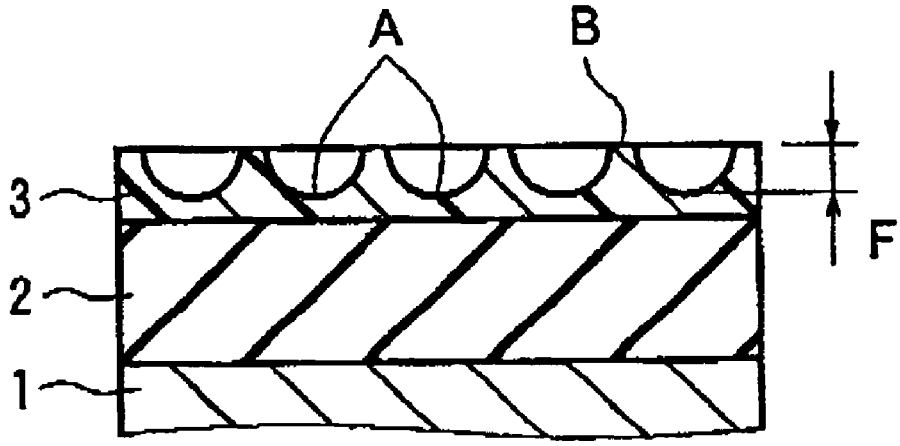

FIG. 1(*a*) and FIG. 1(*b*) illustrate a first embodiment of a developing roll according to the present invention. The developing roll in this embodiment includes a solid core shaft 1, a cylindrical elastic layer 2 provided on an outer peripheral surface of the shaft 1, and a cylindrical outermost layer 3 provided on an outer peripheral surface of the elastic layer 2. A cross-section (plane in a direction perpendicular to an axis) of the outermost layer 3 is usually formed into a perfect circle. Multiple dimples "A" are distributed in such a manner that open ends thereof do not overlap one another on the outer peripheral surface of the outermost layer 3, so that the outer peripheral surface is formed into a rough surface. Thus, a portion "B" other than the dimples "A" on the surface forms a remaining portion of a cylindrical shape.

In detail, the open end of each dimple "A" is preferably an approximate circle and each dimple "A" itself forms preferably a part of an approximate sphere (for example, a hemisphere) in terms of easy formation. Further, each dimple "A" preferably has an open end diameter "D" of 20 to 200 μm and a depth "F" of 1.5 to 20 μm, more preferably an open end diameter "D" of 50 to 120 μm and a depth "F" of 3 to 10 μm, respectively, in terms of toner transportability suitable for the developing roll. In the present invention, 'an open end diameter "D" of each dimple "A"' represents an average value of ten values obtained by observing the outer peripheral surface of the developing roll by means of an electron microscope, randomly selecting ten dimples and measuring the open end diameter "D" of the dimples "A". Further, 'a depth "F" of each dimple'represents an average value of ten values obtained by cutting the developing roll in thickness direction, observing the cross-section by means of an electron microscope, randomly selecting ten dimples and measuring the depth "F" of the dimples "A". Still further, the shape of the open end is not limited to a circle and may be an ellipse, a quadrilateral and a rhombus, which are meant to be included into a "pseudo-circle" shape of the present invention.

The multiple dimples "A" are formed in such a manner that open ends thereof do not overlap one another. The distance "E" between open ends of adjoining dimples "A" is preferably 0 to 50 μm, more preferably 0 to 10 μm, in terms of surface roughness suitable for the developing roll. In the present invention, 'the distance "E" between open ends of adjoining dimples "A"' represents an average value of ten values obtained by observing the outer peripheral surface of the developing roll by means of an electron microscope, randomly selecting ten distances and measuring the distances.

Since the surface roughness of the developing roll is uniformed on the entire outer peripheral surface thereof, the dimples "A" are regularly distributed circumferentially and axially. For example, the dimples "A" are formed in such a manner that a pitch is maintained circumferentially and axially.

Such distribution of the dimples "A" is not particularly limited. Rows of dimples "A" consecutively aligned axially may be inclined to an axis of the developing roll. Alternatively, each dimple "A" in a row may be incorporated into a space defined between two dimples "A" in another row so as to increase density of dimples. "A"

Figure 2:
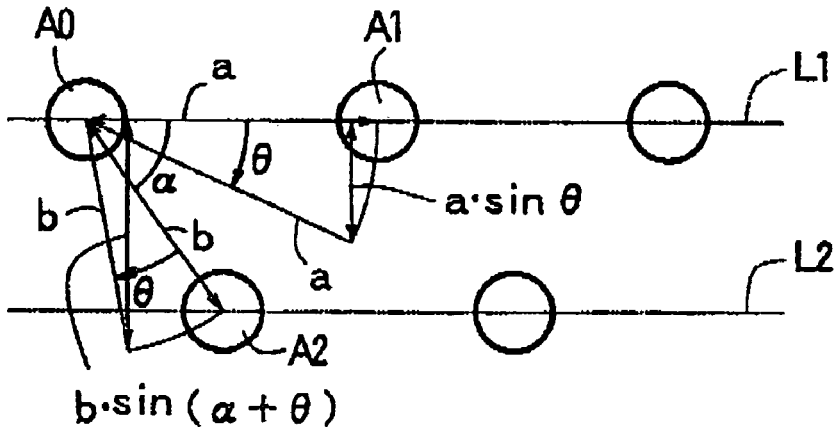
FIG. 2 is a view illustrating how to calculate an inclined angle of a row of dimples.

For example, when rows of dimples "A" are inclined to the axis, an angle of inclination is determined as follows. As shown in FIG. 2, a distance between centers of adjoining dimples "A0" and "A1" in a first row "L1" is named "a", a distance between each center of the dimple "A0" in the first row "L1" and the dimple "A2", nearest to "A0" in a second row "L2", which is a line circumferentially adjacent to the first row "L1", is named "b", an angle formed between two lines "a" and "b" is named "α". Now, if the original line "L1" and the original line "L2" are inclined at an angle of "θ" centered upon "A0", a distance between the first line "L1" and the moved position of "A1" is (a−sin θ), while a distance between the line "L1" and the moved position of "A2" is (b·sin(α+θ)). When these two distances are equal (please refer to the following formula (1)), a row of dimples (i.e., the line contains the moved positions of "A1" and "A2") is formed in parallel with the axis again. Therefore, when an angle of inclination is less than the angle "θ", in which a row of dimples is formed in parallel with the axis again (please refer to the formula (2)), such a row is inclined from one end to the other end to the central axis of the developing roll.

In other words, when the formula (1) is solved for "θ", the following formula (2) is obtained. For example, when a=b=55 μm and α=90°, (if rows of dimples are formed axially and circumferentially at even intervals,) θ=45° is obtained. Therefore, it is found that an angle of inclination is less than 45°.

$$\alpha \cdot \sin\theta = b \cdot \sin(\alpha+\theta) \quad (1)$$

$$\theta = \tan^{-1}\{b \cdot \sin\alpha / (a - b \cdot \cos\alpha)\} \quad (2)$$

When the rows of dimples are inclined to the central axis of the developing roll, each row of dimples contacts an object material such as a photoreceptor drum gradually from one end to the other end in a row consecutively as the developing roll rotates, even fewer image defects such as uneven concentration and streaks may be caused. Actually, a developing roll having an angle of inclination of 0° when a=b=55 μm (each open end diameter of the dimples was 5 μm) and developing rolls each having an angle of inclination of 0.1°, 22.5° and 45° were incorporated into an actual machine, respectively. As a result of comparison, image defects such as uneven concentration and streaks were slightly identified in the case where each developing roll having an angle of inclination of 0° and 45°, respectively, was incorporated. On the other hand, image defects such as uneven concentration and streaks were not identified in the case where each developing roll having an angle of inclination of 0.1° and 22.5°, respectively, was incorporated. When a=b=220 μm (each open end diameter of the dimples was 200 μm), the same results were obtained as above.

Such developing rolls are produced by forming the dimples "A" after forming the outermost layer 3. The exemplary methods for forming the dimples "A" include a method using a transfer mold formed by electroforming, a method of laser processing, such as laser etching, directly conducted onto the developing roll, a method of pressing a heated transfer plate wherein protrusions corresponding to the dimples are mechanically formed and a method of forming a desired finely designed shape by irradiation of light by means of photoresist materials. For example, in the case of laser processing, if a reflection layer wherein titanium particles are included is aligned under a processed layer so as to reflect laser and thus laser processing is conducted only on the intended processed layer for forming the dimples.

Now, an exemplary method for producing the developing roll as described above will be described in detail. In the first instance, the method of laser etching an outer peripheral surface of the outermost layer 3 is described. First, an adhesive agent or the like is applied on an outer peripheral surface of a shaft 1, as required, and the thus treated shaft is co-axially arranged in a space of a mold, which, in turn, is sealed, and then the material for forming an elastic layer 2 is put therein so as to be formed. Next, the entire mold is put into an oven or the like for vulcanization so that the elastic layer 2 (usually having a thickness of about 0.5 to 5 mm) is formed. The mold used in this method preferably has a mirror surface obtained by polishing a mold surface (inner wall) such that ten-point mean roughness (Rz) is less than 2 μm. Thereby, an outer peripheral surface of the elastic layer 2 is formed into a mirror surface. After unmolding the resultant product, the material for forming the outermost layer 3 is coated on the outer peripheral surface of the elastic layer 2 by means of a roll coating method, a spray coating method, a dipping method or the like and then is dried (cured) so that the outermost layer 3 (usually having a thickness of about 3 to 50 μm) is formed. Since the outer peripheral surface of the elastic layer 2 is formed into a mirror surface, the outer peripheral surface of the outermost layer 3 can be formed into a smooth surface. Thus, a roll body can be obtained.

Then, dimples "A" are formed on an outer peripheral surface of the outermost layer 3 by the above-mentioned laser etching or the like. In using laser etching, laser beams are focused upon minute dots by a lens system so as to form dots having high laser fluence on the outer peripheral surface of the outermost layer 3, so that minute dimples "a" as above are formed. For example, when a number of the above-mentioned lens systems are aligned in a line along an axial direction of the thus obtained roll body and minute dots being focused with laser beams by the lens system are scattered axially from one end to the other end on the outer peripheral surface of the outermost layer 3, multiple dimples "A" are formed at one time on such scattered spots. Further, when the roll body is rotated intermittently circumferentially and laser beams are irradiated thereon synchronously intermittently, multiple dimples "A" are formed in distribution on an outer peripheral surface of the outermost layer 3. In such a formation of the dimples "A", when minute dots being focused with laser beams by the lens system are scattered at specified intervals and also the intermittent rotation of the roll body is adjusted at specified angles, multiple dimples are formed axially and circumferentially at regular intervals. Further, each size of the dimples "A" is adjusted by adjusting output, irradiation time and the like of laser beams. After formation of the dimples "A", the outer peripheral surface of the outermost layer 3 is polished, as required. Thus, the above-mentioned developing roll can be produced. As a laser beam, an Nd-YAG laser or an excimer laser is used. Alternatively, the dimples "A" are formed by scanning one laser beam axially on the roll body with intermittent irradiation of such a laser beam during scanning.

In such a formation of the dimples "A", distribution density of the dimples "A" can be relatively easily controlled by adjusting the lens system for use in laser etching, adjusting the intermittent rotation of the roll body, or the like. Further, the size of the dimples "A" can be relatively easily controlled by adjusting output, irradiation time, or the like of laser beams. Thus, since the formation of the dimples "A" can be relatively easily controlled, a surface roughness on an outer peripheral surface of the developing roll can be relatively easily controlled. Further, variation in the surface roughness can be relatively easily lessened and thus transportability of toner can be uniformed. Especially, since the dimples "A" can be formed axially and circumferentially at regular intervals relatively easily by adjusting the lens system for use in laser etching, adjusting the intermittent rotation of the roll body, or the like, a surface roughness on an outer peripheral surface of the developing roll can be further uniformed and thus transportability of toner can be further uniformed.

As another exemplary method for producing the developing roll, a method for forming dimples "A" on an outer peripheral surface of the outermost layer 3 by using a transfer mold will be described in detail. As a transfer mold, for example, used is a cylindrical mold, capable of being separated into two parts axially, wherein multiple protrusions corresponding to the dimples "A" are formed in distribution on an inner wall. The roll body is supported by the transfer mold in such a manner that the outer peripheral surface of the outermost layer 3 of the roll body abuts against the inner wall of the transfer mold, and is heated in such a state. Thus, the protrusions of the transfer mold are transferred onto the outer peripheral surface of the outermost layer 3, so that the dimples "A" can be formed. After formation of the dimples "A", the outer peripheral surface of the outermost layer 3 is polished, as required. The developing roll as above can be also produced in this manner.

The above-mentioned transfer mold can be produced, for example, by an electroforming method. First, an aluminum cylinder having the same diameter as that of the intended developing roll is prepared. Similarly to the laser etching method for forming dimples "A" on the outer peripheral surface of the outermost layer 3, dimples are formed by laser etching an outer peripheral surface of the aluminum cylinder. Such dimples are formed into the same shapes of intended dimples to be formed on an outer peripheral surface of the outermost layer 3. The thus treated aluminum cylinder, as an original mold, is soaked into plating solution and is electroplated for forming a metal plated layer (usually having a thickness of 2 to 7 mm), such as nickel, on a surface of the original mold. In turn, the thus treated aluminum cylinder is withdrawn from the plating solution, and cleaning, drying and the like are conducted. The thus produced plated layer is axially halved into two pieces, which are unmolded from the original mold, respectively. Thereby, the transfer mold composed of the above two separated pieces can be obtained. The outer peripheral surface of the original mold (aluminum cylinder having the outer peripheral surface wherein dimples are formed) is transferred to the inner wall of the thus obtained transfer mold, wherein protrusions corresponding to dimples formed in the outer peripheral surface of the original mold are formed. Thus, since the outer peripheral surface of the original mold is transferred to the inner wall of the transfer mold, which is further transferred to the outer peripheral surface of the outermost layer 3 of the developing roll, the aluminum cylinder for use preferably has a mirror surface obtained by polishing the peripheral surface thereof such that ten-point mean roughness (Rz) is less than 2 μm, so that a remaining portion "B", in which dimples "A" are not formed, becomes smooth.

As a further another exemplary method for producing the developing roll, a method of pressing a heated transfer plate wherein protrusions corresponding to the dimples are formed will be described in detail. In this method, protrusions of the transfer plate are transferred to an outer peripheral surface of the outermost layer 3 by pressing the roll body on the thus heated transfer plate. The protrusions can be formed uniformly on the transfer plate by laser processing or mechanical processing on a metal plate. Alternatively, after applying the material for forming the outermost layer 3 on the outer peripheral surface of the elastic layer 2, both of crosslinking and transferring may be simultaneously conducted by pressing the transfer plate heated to 200° C. on the thus obtained outermost layer 3.

The outer peripheral surface of the thus obtained developing roll is formed into a rough surface by forming multiple dimples "A" in distribution on the outer peripheral surface of the outermost layer 3 without using hard particles. For this reason, the surface hardness can be maintained low and thus stress imparted on toner can be reduced. Further, since the surface roughness does not suffer from cohesion of the hard particles and thus does not change with time, the surface roughness can be constantly maintained for a long time. To improve releasability and durability of toner, surface treatment using chlorine may be conducted, as required.

Since the rough surface is formed such that open ends of the dimples "A" do not overlap one another, a portion "B" (remaining portion of a cylindrical shape) other than the dimples "A" on the outer peripheral surface maintains the original state (before formation of the dimples "A") and thus is not roughened. When the developing roll of the present invention contacts a layer-forming blade, a photoreceptor drum or the like with pressure, such pressure contact is conducted by the portion "B" (remaining portion of a cylindrical shape) other than the dimples "A". For this reason, such pressure contact becomes so-called surface contact conducted axially from one end to the other end of the developing roll, so that variation in contact pressure can be lessened. Thereby, high image quality, free from uneven concentration, streaks, distortion and the like, can be obtained. For example, approximate uniform pressure contact can be conducted in pressure contact with the layer-forming blade, a toner layer having a uniform thickness can be formed on an outer peripheral surface of the developing roll, so that high image quality can be obtained. Further, dimples "A" may be partly overlapped as long as it may not affect variation in pressure contact.

Figure 3:
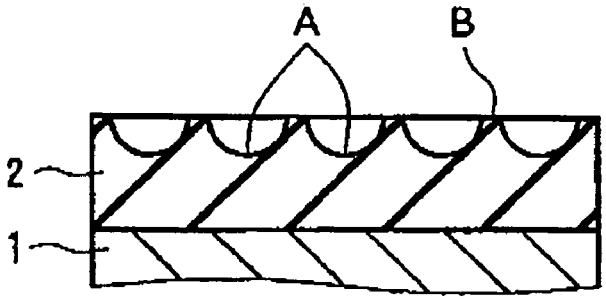
FIG. 3 is a sectional view illustrating a second embodiment of a developing roll according to the present invention, which corresponds to a sectional view in an X-X line of FIG. 1(*a*)

Next, the second embodiment of the developing roll according to the present invention will be described hereinafter. The developing roll of this embodiment comprises a solid core shaft 1 and a cylindrical elastic layer 2 formed on an outer peripheral surface of the shaft 1, as shown in FIG. 3. The outer peripheral surface of the elastic layer 2 is formed into a rough surface by distribution of multiple dimples "A" in such a manner that open ends thereof do not overlap one another on the surface A portion "B" other than the dimples "A" forms a remaining portion of a cylindrical shape. The dimples "A" can be formed in the same manner as in the above-mentioned first embodiment. Further, the dimples "A" can be formed by using the transfer mold obtained by an electroforming method as a mold for forming the elastic layer 2 in this embodiment. The developing roll in the second embodiment has the same effects and advantages as those of the first embodiment.

Figure 4:
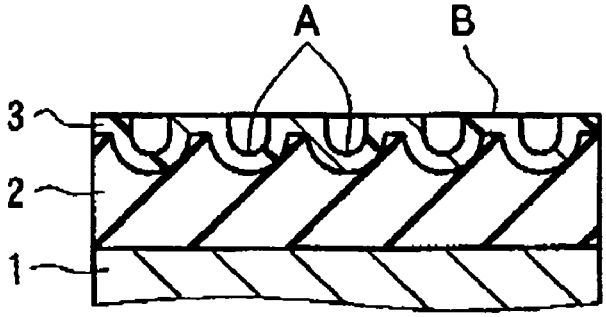
FIG. 4 is a sectional view illustrating a third embodiment of a developing roll according to the present invention, which corresponds to a sectional view in an X-X line of FIG. 1(*a*)

Next, the third embodiment of the developing roll according to the present invention will be described hereinafter. The developing roll of this embodiment, as shown in FIG. 4, is obtained by forming an outermost layer 3 on an outer peripheral surface of the elastic layer 2 of the developing roll in the above-mentioned second embodiment in the same manner as in the above-mentioned first embodiment. The outermost layer 3 is formed into a rough surface since an uneven surface of the elastic layer 2 emerges on the outer peripheral surface of the outermost layer 3, i.e., the developing roll. The developing roll in the third embodiment has the same effects and advantages as those of the first embodiment.

Figure 5:
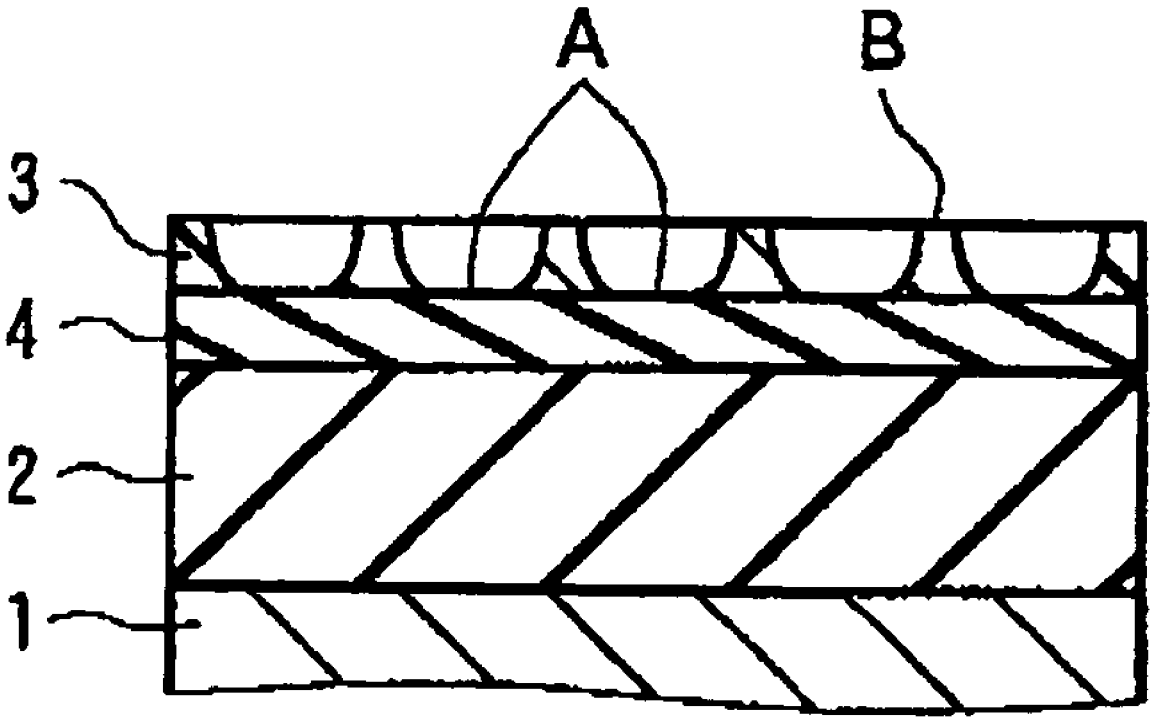
FIG. 5 is a sectional view illustrating a fourth embodiment of a developing roll according to the present invention, which corresponds to a sectional view in an X-X line of FIG. 1(*a*).

Next, the fourth embodiment of the developing roll according to the present invention will be described hereinafter. The developing roll of this embodiment, as shown in FIG. 5, further includes a reflection layer 4 for reflecting laser formed as an intermediate layer between the elastic layer 2 and the outermost layer 3 of the developing roll shown in FIG. 1. When forming dimples "A" on the outer peripheral surface of the outermost layer 3 by laser etching, the reflection layer 4 reflects laser and thus the dimples "A" are formed only on the outermost layer 3. In this case, where a laser beam reaches the reflection layer 4, the outer peripheral surface of the reflection layer 4 emerges on each bottom of the thus formed dimples "A", because the reflection layer 4 is not etched. For this reason, depths of the dimples "A" can be controlled by forming the reflection layer 4. The developing roll in the fourth embodiment has the same effects and advantages as those of the first embodiment.

In the fourth embodiment, the reflection layer 4 can be obtained by mixing at least one material of white materials, such as titanium oxide, barium sulfate or zinc oxide, into the material for forming the intermediate layer, which will be described later. The mixing ratio of the titanium oxide or the like is preferably 10 to 100 parts by weight based on the 100 parts by weight of the main material (such as rubber) for forming the intermediate layer in terms of effective reflection of laser. The wavelength of the laser at that time is preferably 500 to 1500 nm.

Next, the fifth embodiment of the developing roll according to the present invention will be described hereinafter. The developing roll of this embodiment is obtained by conducting surface treatment for improving toner releasability on an outer peripheral surface of the elastic layer 2 of the developing roll in the above-mentioned second embodiment (shown in FIG. 3). Thereby, deterioration of image quality caused by toner adhesion to the surface of the developing roll at endurance time (after a long-time consecutive use) can be reduced. The developing roll in the fifth embodiment has the same effects and advantages as those of the first embodiment.

In the fifth embodiment, examples of the surface treatment include isocyanate treatment, siloxane treatment, fluoride treatment, chlorine treatment, ultraviolet treatment, plasma treatment and corona treatment.

Next, the sixth embodiment of the developing roll according to the present invention will be described hereinafter. The developing roll of this embodiment is obtained by conducting surface treatment, as same as in the fifth embodiment, on an outer peripheral surface of the outermost layer 3 of the developing roll in the above-mentioned first embodiment (shown in FIG. 1). The developing roll in the sixth embodiment has the same effects and advantages as those of the fifth embodiment.

Now, each material is described for forming the shaft 1, the elastic layer 2 and the outermost layer 3 of the developing roll according to the present invention.

The shaft 1 is not particularly limited and may be a solid core shaft or a hollow cylindrical shaft having a hollow interior. The material for forming the shaft 1 is not particularly limited and, for example, may be composed of iron, plated iron, stainless steel, aluminum or the like. An adhesive, a primer or the like is usually applied on an outer peripheral surface of the shaft 1, as required. Further, the adhesive, the primer or the like may be electrically conductive, as required.

The material for forming the elastic layer 2 includes a main component, as follows, and an electrically conductive agent. The main component is not particularly limited, however, examples thereof include polyurethane elastomer, ethylene-propylene-diene rubber (EPDM), styrene-butadiene rubber (SBR), silicone rubber, acrylonitrile-butadiene rubber (NBR), hydrogenated acrylonitrile-butadiene rubber (H-NBR), and chloroprene rubber (CR), which may be used either alone or in combination. Among these rubbers, electrically conductive silicone rubber is preferably used in terms of low hardness and permanent set resistance. Further, the material for forming the elastic layer 2 may include one or more of silicone oil, a vulcanizing agent, a vulcanizing accelerator, lubricant and an auxiliary agent, as required. The thickness of the elastic layer 2 is not particularly limited, however, usually is about 0.5 to 5 mm.

The material for forming the outermost layer 3 includes a main component, as follows, and an electrically conductive agent. The main component is not particularly limited, however, examples thereof include urethane resin, polyamide resin, acrylic resin, acrylic silicone resin, butyral resin (PVB), alkyd resin, polyester resin, fluororubber, fluoroplastic, a mixture of fluororubber and fluoroplastic, silicone resin, silicon-grafted acrylic polymer, acryl-grafted silicone polymer, nitrile rubber and urethane rubber, which may be used either alone or in combination. Among them, urethane resin is preferably used in terms of abrasion resistance.

Further, an intermediate layer may be formed between the elastic layer 2 and the outermost layer 3, as required. The material for forming the intermediate layer includes a main component, as follows, and an electrically conductive agent. The main component is not particularly limited, however, examples thereof include hydrogenated acrylonitrile-butadiene rubber (hydrogenated nitrile rubber; H-NBR), acrylonitrile-butadiene rubber (nitrile rubber; NBR), polyurethane elastomer, chloroprene rubber (CR), natural rubber, butadiene rubber (BR), acrylic rubber (ACM), isoprene rubber (IR), styrene-butadiene rubber (SBR), hydrin rubber (ECO, CO), urethane rubber and fluororubber, which may be used either alone or in combination. Among them, H-NBR and polyurethane elastomer are preferably used in terms of adhesion and stability of coating liquid.

Next, an explanation will be given to Examples and Comparative Examples.

EXAMPLE 1

A developing roll was produced by using a shaft, materials for forming each layer, a transfer mold obtained by electroforming and forming an elastic layer on an outer peripheral surface of the shaft and then forming an outermost layer thereon.

Shaft

A solid core cylindrical shaft, made of iron, having a diameter of 8 mm and a length of 350 mm was prepared.

Material for Forming Elastic Layer

The material for forming an elastic layer 2 was prepared by kneading an electrically conductive silicone rubber (X34-270A/B available from Shin-Etsu Chemical Co. Ltd. of Tokyo, Japan) by means of a kneader.

Material for Forming Outermost Layer

The material for forming an outermost layer was prepared by using 40 parts by weight of carbon black (DENKA BLACK HS-100 available from DENKI KAGAKU KOGYO KABUSHIKI KAISHA of Tokyo, Japan) based on 100 parts by weight of polycarbonate diol urethane resin (Nippolan 5196 available from Nippon Polyurethane Industry Co., Ltd. of Tokyo, Japan), kneading the mixture by means of a ball mil, adding 400 parts by weight of methyl ethyl ketone (MEK) thereto, and mixing and stirring the resultant mixture.

Production of Transfer Mold

Similarly to the above-mentioned embodiment, an aluminum cylinder having the same diameter as that of the intended developing roll was prepared. Multiple dimples were formed by laser etching an outer peripheral surface of the aluminum cylinder. As the conditions for the laser etching, a kind of laser beam was an Nd-YAG laser and an output was 50 W. A laser beam was irradiated on an outer peripheral surface of the aluminum cylinder at widths of 50 mm, while the aluminum cylinder was rotated at an output of 35 A and a frequency of 5 kHz and with an irradiation speed of 1030 mm/sec. Thus, an aluminum master roll was obtained, and thereby a transfer mold was produced by electroforming.

Production of Roll Body

An elastic layer (thickness: 4 mm, length: 240 mm) was formed on an outer peripheral surface of the shaft by molding (at 190° C. for 30 minutes) using the thus obtained transfer mold. Thereby, multiple dimples were formed in distribution on the outer peripheral surface of the elastic layer. These dimples were formed axially and circumferentially at regular intervals (both intervals between adjoining dimples axially and circumferentially were 5 μm, respectively) in such a manner that open ends thereof did not overlap one another.

Production of Developing Roll

The material for forming an outermost layer was coated on an outer peripheral surface of the elastic layer by a roll coating method and was dried (cured) for forming the outermost layer (thickness: 5 μm). Thereby, a developing roll was obtained. The ten point mean roughness (Rz) on a remaining portion, where dimples were not formed, on an outer peripheral surface of the outermost layer was 2.5 μm. The ten point mean roughness (Rz) was measured by means of a surface texture and contour measuring instrument (SURFCOM 1400D available from Tokyo Seimitsu Co., Ltd.). Further, the open end of each dimple was an approximate circle (open end diameter: 200 μm) after formation of the outermost layer and each dimple formed a part of an approximate sphere (depth of each dimple: 5 μm).

EXAMPLE 2

A developing roll was prepared in substantially the same manner as in Example 1, except that conditions were changed; an output of 28 A, a frequency of 5 kHz and an irradiation speed of 625 mm/sec for forming dimples each having an open end diameter of 120 μm on the outer peripheral surface of the outermost layer.

EXAMPLE 3

A developing roll was prepared in substantially the same manner as in Example 1, except that conditions were changed; an output of 24.5 A, a frequency of 5 kHz and an irradiation speed of 425 mm/sec for forming dimples each having an open end diameter of 80 μm on the outer peripheral surface of the outermost layer.

EXAMPLE 4

A developing roll was prepared in substantially the same manner as in Example 2, except that conditions were changed; an output of 28 A, a frequency of 5.9 kHz and an irradiation speed of 741 mm/sec for forming dimples each having a depth of 1.5 μm on the outer peripheral surface of the outermost layer.

EXAMPLE 5

A developing roll was prepared in substantially the same manner as in Example 2, except that conditions were changed; an output of 28 A, a frequency of 3.7 kHz and an irradiation speed of 460 mm/sec for forming dimples each having a depth of 10 μm on the outer peripheral surface of the outermost layer.

EXAMPLE 6

A developing roll was prepared in substantially the same manner as in Example 2, except that conditions were changed; an output of 28 A, a frequency of 1 kHz and an irradiation speed of 120 mm/sec for forming dimples each having a depth of 20 μm on the outer peripheral surface of the outermost layer.

EXAMPLE 7

In the EXAMPLE 2, a metallic mesh made of #400 stainless steel (having a hole diameter of about 30 μm) was provided on the aluminum cylinder and laser etching was conducted therethrough. Then, a developing roll was prepared in substantially the same manner as in Example 2, except that conditions were changed; an output of 24.5 A, a frequency of 1 kHz and an irradiation speed of 100 mm/sec for forming dimples each having an open end diameter of 20 μm on the outer peripheral surface of the outermost layer. (However, the thickness of the outermost layer was 20 μm and the distance between circumferentially adjoining dimples was 20 μm.)

EXAMPLE 8

As described below, a developing roll was prepared by producing a roll body comprising a shaft, an elastic layer and an outermost layer, and laser etching an outer peripheral surface of the thus produced roll body for forming a rough surface. Each material for forming the shaft, the elastic layer and the outermost layer was the same as those of the EXAMPLE 1.

Production of Roll Body

Similarly to the above-mentioned embodiment, an elastic layer (thickness: 4 mm, length; 240 mm) was formed on an outer peripheral surface of the shaft by molding (at 190° C. for 30 minutes) using the cylindrical mold. The material for forming an outermost layer was coated on an outer peripheral surface of the elastic layer by means of a roll coating method and then is dried (cured) so as to form the outermost layer (having a thickness of 10 μm). Thereby, the roll body was obtained. The ten point mean roughness (Rz) on the outermost layer of the roll body was 2.5 μm.

Production of Developing Roll

Multiple dimples were formed in distribution on an outer peripheral surface of the roll body (outermost layer) by laser etching. These dimples were formed axially and circumferentially at regular intervals (both intervals between adjoining dimples axially and circumferentially were 5 μm, respectively) in such a manner that open ends thereof did not overlap one another. Further, the open end of each dimple was an approximate circle (open end diameter: 200 μm) and each dimple formed a part of an approximate sphere (depth of each dimple: 5 μm). As the conditions for the laser etching, a kind of laser beam was an Nd-YAG laser, an output was 25 A and a frequency was 30 kHz and an irradiation speed was 3700 mm/sec. Still further, the ten point mean roughness (Rz) on a remaining portion, where dimples were not formed, on the outer peripheral surface of the outermost layer was 2.5 μm.

EXAMPLE 9

A developing roll was prepared in substantially the same manner as in Example 8, except that conditions were changed; an output of 30 A, a frequency of 30 kHz and an irradiation speed of 2000 mm/sec for forming dimples each having an open end diameter of 120 μm and a depth of 5 μm on the outer peripheral surface of the outermost layer.

EXAMPLE 10

A developing roll was prepared in substantially the same manner as in Example 8, except that conditions were changed; an output of 22 A, a frequency of 30 kHz and an irradiation speed of 2500 mm/sec for forming dimples each having an open end diameter of 80 μm and a depth of 5 μm on the outer peripheral surface of the outermost layer.

EXAMPLE 11

A transfer plate having a surface, wherein protrusions each having a diameter of 140 μm and a height of 7 μm were formed, was produced by means of machine processing. A roll body comprising a shaft, an elastic layer and an outermost layer, each prepared in the same manner as in Example 8, was pressed so as to contact the transfer plate heated to 200° C. with pressure of 98 N, and then was rotated for forming dimples each having an open end diameter of 200 μm and a depth of 5 mm on the outer peripheral surface of the outermost layer.

EXAMPLE 12

A developing roll was prepared in substantially the same manner as in Example 11, except that the diameter of each protrusion was changed to 220 μm and the height thereof was changed to 7 μm for forming dimples each having an open end diameter of 120 μm and a depth of 5 μm on the outer peripheral surface of the outermost layer.

EXAMPLE 13

A developing roll was prepared in substantially the same manner as in Example 11, except that the diameter of each protrusion was changed to 90 μm and the height thereof was changed to 7 μm for forming dimples each having an open end diameter of 80 μm and a depth of 5 μm on the outer peripheral surface of the outermost layer.

EXAMPLE 14

A developing roll comprising a shaft and an elastic layer was prepared in substantially the same manner as in Example 2, except that conditions were changed; an output of 27 A, a frequency of 5 kHz and an irradiation speed of 625 mm/sec for forming dimples each having an open end diameter of 120 μm and a depth of 5 μm on the outer peripheral surface of the elastic layer.

EXAMPLE 15

A developing roll comprising a shaft and an elastic layer was prepared in substantially the same manner as in Example 8, except that after formation of the elastic layer, laser etching was conducted on an outer peripheral surface of the elastic layer for forming a rough surface. The conditions were as follows; an output of 25 A, a frequency of 30 kHz and an irradiation speed of 3700 mm/sec for forming dimples each having an open end diameter of 120 μm and a depth of 5 μm on the outer peripheral surface of the elastic layer.

EXAMPLE 16

A developing roll comprising a shaft, an elastic layer, an intermediate layer and an outermost layer was prepared. Each material for forming the shaft, the elastic layer and the outermost layer was the same as that of Example 1, respectively, and the material for forming the intermediate layer was as follows. Further, the elastic layer was formed on an outer peripheral surface of the shaft by using the transfer mold in the same manner as in Example 2. Thereby, a roll body was formed wherein multiple dimples were formed in distribution on an outer peripheral surface of the elastic layer. The material for forming the intermediate layer was coated on an outer peripheral surface of the elastic layer by a roll coating method and was crosslinked (at 180° C. for 60 minutes) for forming the intermediate layer (thickness: 10 μm). Then, the outermost layer (thickness: 5 μm) was formed on an outer peripheral surface of the intermediate layer in the same manner as in Example 1. Thereby, a developing roll was obtained. Each dimple formed on the outer peripheral surface of the outermost layer had an open end diameter of 120 μm and a depth of 5 μm. The ten point mean roughness (Rz) on a remaining portion, where dimples were not formed, on the outer peripheral surface of the outermost layer was 2.5 m. Other than that, Example 16 was the same as Example 1.

Material for Forming Intermediate Layer

20% by weight of the material for forming the intermediate layer was prepared by mixing 0.5 parts by weight of stearic acid, 5 parts by weight of zinc oxide (ZnO), 1 part by weight of dithiocarbamate vulcanizing accelerator (BZ), 2 parts by weight of sulfenamide vulcanizing accelerator (CZ) and 1 part weight of sulfur, kneading the mixture by means of a roll, adding an organic solvent mixture of MEK and toluene (MEK:toluene (weight ratio)=2:1) thereto, and stirring the resulting mixture.

EXAMPLE 17

After producing a roll body having a three-layer structure by using the above-mentioned shaft and the above-mentioned material for forming each layer in the following manner, the laser etching was conducted on an outer peripheral surface of the thus produced roll body (outer peripheral surface of the outermost layer) for forming a rough surface. Thus, a developing roll was produced. The conditions were substantially the same as in Example 8 except that conditions were changed; an output of 25 A, a frequency of 30 kHz and an irradiation speed of 1800 mm/sec. Thereby, each dimple had an open end diameter of 120 μm and a depth of 5 μm. The ten point mean roughness (Rz) on a remaining portion, where dimples were not formed, on an outer peripheral surface of the outermost layer was 2.5 μm.

Production of Roll Body

An elastic layer (thickness: 3 mm) was formed on an outer peripheral surface of the shaft by molding (at 170° C. for 30 minutes) using the cylindrical mold. The material for forming the intermediate layer was coated on an outer peripheral surface of the elastic layer by means of a roll coating method and then is crosslinked (at 180° C. for 60 minutes) so as to form the intermediate layer (having a thickness of 10 μm). The material for forming the outermost layer was coated on an outer peripheral surface of the elastic layer by means of a roll coating method and then is dried (cured) so as to form the outermost layer (having a thickness of 10 μm). Thereby, the roll body was obtained. The ten point mean roughness (Rz) on the outermost layer of the roll body was 2.5 μm.

EXAMPLE 18

A developing roll was produced by producing a roll body having a three-layer structure in the same manner as in Example 17 and then an outer peripheral surface of the roll body was rotated onto a heated transfer plate with pressure.

Production of Transfer Plate

An aluminum plate (230 mm×50 mm) was prepared. Multiple dimples were formed in distribution on the aluminum plate by laser etching. As the conditions for the laser etching, a kind of laser beam was an Nd-YAG laser, an output was 28 A, a frequency was 5 kHz and an irradiation speed was 625 mm/sec. Thereby, an aluminum master plate was obtained and then a transfer plate was produced by using the aluminum master plate by means of electroforming. Multiple protrusions were formed uniformly in distribution on a surface of the transfer roll.

Production of Developing Roll

The roll body was rotated onto the surface of the transfer plate heated to 200° C. with uniform pressure of a load of 98N, so that multiple protrusions of the transfer plate were transferred onto an outer peripheral surface of the roll body. These dimples were formed axially and circumferentially at regular intervals (both intervals between adjoining dimples axially and circumferentially were 5 μm, respectively) in such a manner that open ends thereof did not overlap one another. Further, the open end of each dimple was an approximate circle (open end diameter: 120 μm) and each dimple formed a part of an approximate sphere (depth of each dimple: 5 μm). The ten point mean roughness (Rz) on a remaining portion, where dimples were not formed, on an outer peripheral surface of the outermost layer was 2.5 μm.

EXAMPLE 19

Example 19 was substantially the same as Example 17 except that an intermediate layer was a reflection layer for reflecting laser, which was produced by using the material prepared by adding 30 parts by weight of titanium oxide (ET-300W available from Ishihara Industry Co., Ltd.) (based on 100 parts by weight of H-NBR) to the material for forming the intermediate layer of Example 17.

EXAMPLE 20

A roll body wherein multiple dimples were formed in distribution was produced by using the transfer mold of Example 16, and the shaft body and the material for forming the elastic layer of Example 1, and forming the elastic layer on an outer peripheral surface of the shaft. Then, a surface treatment (with isocyanate) improving toner releasability was conducted on an outer peripheral surface of roll body by coating Coronate HX (available from Nippon Polyurethane Industry Co., Ltd.) and heating at 160° C. for one hour. Each dimple formed on the outer peripheral surface of the elastic layer had an open end diameter of 120 μm and a depth of 5 μm. The ten point mean roughness (Rz) on a remaining portion, where dimples were not formed, on an outer peripheral surface of the outermost layer was 2.5 μm.

COMPARATIVE EXAMPLE 1

Comparative Example 1 was prepared in substantially the same manner as in Example 8, except that the following material (including particles) was used as the material for forming on outermost layer and laser etching was not conducted on the outermost layer.

Material for Forming Outermost Layer

The material for forming the outermost layer was prepared by adding silica powders (Sylosphere C1510 (average particle diameter of 10 μm) available from Fuji Silysia Chemical Ltd.) to the material for forming the outermost layer of Example 8. The mixing ratio of the silica powders was 20 parts by weight based on 100 parts by weight of polycarbonate diol urethane resin.

COMPARATIVE EXAMPLE 2

Comparative Example 2 was prepared in substantially the same manner as in Example 17, except that the same material for forming the outermost layer (including particles) as that of Comparative Example 1 was used and laser etching was not conducted on the outermost layer.

Uneven Concentration

Each developing roll of the thus obtained Examples 1 to 20 and Comparative Examples 1 and 2 was incorporated into a commercially available electrophotographic apparatus (LBP-2510, Laser Shot, available from Canon Inc.). Solid black images were outputted at 20° C.×50% RH. Whether uneven concentration appeared or not was visually observed. The results are shown in the following Tables 1 to 4, wherein the symbol ○ indicates that no uneven concentration was identified, the symbol Δ indicates that uneven concentration was slightly identified.

Occurrence of Fog Phenomenon

After 8,000 copies of the above-mentioned image were outputted at 32.5° C.×85% RH, the concentration on white portions on a surface of a photoreceptor drum was measured by means of by a Macbeth densitometer. The results are also shown in the following Tables 1 to 4, wherein the symbol ○ indicates that fog phenomenon (i.e., toner is scattered in a non-image portion on a sheet of paper) was hardly occurred when the concentration was less than 0.2, and the symbol Δ indicates that fog phenomenon was slightly occurred when the concentration was not less than 0.2 and less than 0.4, and then the symbol × indicates that fog phenomenon was clearly occurred when the concentration is not less than 0.4.

Streaks

After 8,000 copies were outputted as above, whether streaks appeared or not was visually observed. The results are also shown in the following Tables 1 to 4, wherein the symbol ○ indicates that no streaks were identified, while the symbol Δ indicates that streaks were partly identified.

Distortion

After 8,000 copies were outputted as above, whether distortion appeared or not was visually observed. The results are also shown in the following Tables 1 to 4, wherein the symbol ○ indicates that no distortion was identified, the symbol Δ indicates that distortion was slightly identified, and the symbol × indicates that distortion was identified all over.

TABLE 1

| | EXAMPLE | | | | | | |
|---|---|---|---|---|---|---|---|
| Dimples | 1 | 2 | 3 | 4 | 5 | 6 | 7 |
| Open end diameter (μm) | 200 | 120 | 80 | 120 | 120 | 120 | 20 |
| Depth (μm) | 5 | 5 | 5 | 1.5 | 10 | 20 | 5 |

TABLE 1-continued

| | EXAMPLE | | | | | | |
|---|---|---|---|---|---|---|---|
| Dimples | 1 | 2 | 3 | 4 | 5 | 6 | 7 |
| Uneven concentration | Δ | ○ | ○ | ○ | ○ | Δ | ○ |
| Fog phenomenon | ○ | ○ | ○ | ○ | ○ | ○ | ○ |
| Streaks | Δ | Δ | ○ | Δ | Δ | Δ | Δ |
| Distortion | ○ | ○ | ○ | Δ | ○ | Δ | ○ |

TABLE 2

| | EXAMPLE | | | | | |
|---|---|---|---|---|---|---|
| Dimples | 8 | 9 | 10 | 11 | 12 | 13 |
| Open end diameter (μm) | 200 | 120 | 80 | 200 | 120 | 80 |
| Depth (μm) | 5 | 5 | 5 | 5 | 5 | 5 |
| Uneven concentration | Δ | ○ | ○ | Δ | ○ | ○ |
| Fog phenomenon | ○ | ○ | ○ | ○ | ○ | ○ |
| Streaks | Δ | Δ | ○ | Δ | Δ | ○ |
| Distortion | ○ | ○ | ○ | ○ | ○ | ○ |

TABLE 3

| | EXAMPLE | | COMPARATIVE EXAMPLE |
|---|---|---|---|
| Dimples | 14 | 15 | 1 |
| Open end diameter (μm) | 120 | 120 | — |
| Depth (μm) | 5 | 5 | — |
| Uneven concentration | ○ | ○ | ○ |
| Fog phenomenon | Δ | Δ | X |
| Streaks | Δ | Δ | Δ |
| Distortion | Δ | Δ | X |

TABLE 4

| | EXAMPLE | | | | | COMPARATIVE EXAMPLE |
|---|---|---|---|---|---|---|
| Dimples | 16 | 17 | 18 | 19 | 20 | 2 |
| Open end diameter (μm) | 120 | 120 | 120 | 120 | 120 | — |
| Depth (μm) | 5 | 5 | 5 | 5 | 5 | — |
| Uneven concentration | ○ | ○ | ○ | ○ | ○ | ○ |
| Fog phenomenon | ○ | ○ | ○ | ○ | ○ | X |
| Streaks | Δ | Δ | Δ | ○ | Δ | Δ |
| Distortion | ○ | ○ | ○ | ○ | Δ | X |

As can be understood from the results shown in Tables 1 to 4, since fog phenomenon was slightly occurred in the developing rolls of the Examples 1 to 20, toner transportability was suitable. On the other hand, fog phenomenon was clearly occurred in the developing rolls of the Comparative Examples 1 and 2, toner transportability was not suitable. Further, since distortion of the developing rolls of Examples 1 to 20 was fewer as compared with Comparative Examples 1 and 2, each developing roll of Examples 1 to 20 was pressed onto a layer forming blade, a photoreceptor drum or the like with more uniform pressure as compared with Comparative Examples 1 and 2.

What is claimed is:

1. A developing roll comprising a shaft, an elastic layer provided on an outer peripheral surface of the shaft, and a cylindrical outermost layer provided directly or indirectly via a layer on an outer peripheral surface of the elastic layer, wherein a reflection layer for reflecting a laser is formed between the elastic layer and the cylindrical outermost layer, and an outer peripheral surface of the cylindrical outermost layer is formed into a rough surface by distribution of multiple dimples in such a manner that open ends thereof do not overlap one another on the surface.

2. The developing roll according to claim 1, wherein each dimple has a pseudo-circle shape, an open end diameter of 20 to 200 μm and a depth of 1.5 to 20 μm.

3. The developing roll according to claim 1, wherein dimples are regularly distributed circumferentially and axially.

4. A developing roll comprising a shaft and a cylindrical elastic layer provided on an outer peripheral surface of the shaft, wherein an outer peripheral surface of the cylindrical elastic layer is formed into a rough surface by distribution of multiple dimples in such a manner that open ends thereof do not overlap one another on the surface, and surface treatment is conducted on the outer peripheral surface of the cylindrical elastic layer for increasing toner releasability.

5. The developing roll according to claim 4, wherein each dimple has a pseudo-circle shape, an open end diameter of 20 to 200 μm and a depth of 1.5 to 20 μm.

6. A developing roll comprising a shaft, an elastic layer provided on an outer peripheral surface of the shaft and a cylindrical outermost layer provided directly or indirectly via a layer on an outer peripheral surface of the elastic layer, wherein an outer peripheral surface of the cylindrical outermost layer is formed into a rough surface by distribution of multiple dimples in such a manner that open ends thereof do not overlap one another on the surface, and surface treatment is conducted on the outer peripheral surface of the cylindrical outermost layer for increasing toner releasability.

7. The developing roll according to claim 6, wherein each dimple has a pseudo-circle shape, an open end diameter of 20 to 200μm and a depth of 1.5 to 20 μm.

8. A developing roll comprising a shaft, an elastic layer provided on an outer peripheral surface of the shaft, and a cylindrical outermost layer provided directly or indirectly via a layer on an outer peripheral surface of the elastic layer, wherein an outer peripheral surface of the cylindrical outermost layer is formed into a rough surface by distribution of multiple dimples in a plurality of rows extended from one end to the other end of the outer peripheral surface of the cylindrical outermost layer in such a manner that open ends thereof do not overlap one another on the surface, wherein each row of dimples is inclined to a central axis of the developing roll.

9. The developing roll according to claim 8, wherein a reflection layer for reflecting a laser is formed between the elastic layer and the cylindrical outermost layer.

10. The developing roll according to claim 8, wherein each dimple has a pseudo-circle shape, an open end diameter of 20 to 200 μm and a depth of 1.5 to 20 μm.

11. The developing roll according to claim 8, wherein dimples are regularly distributed circumferentially and axially.

* * * * *